US009833717B2

(12) United States Patent
Ochi

(10) Patent No.: US 9,833,717 B2
(45) Date of Patent: Dec. 5, 2017

(54) ORNAMENT MECHANISM, AND ORNAMENT, SPORTS EQUIPMENT, AND AMUSEMENT EQUIPMENT USING SAME

(71) Applicant: BLD Oriental Co., Ltd., Izumisano, Osaka (JP)

(72) Inventor: Yasushi Ochi, Osaka (JP)

(73) Assignee: BLD Oriental Co., Ltd. (JP)

( * ) Notice: Subject to any disclaimer, the term of this patent is extended or adjusted under 35 U.S.C. 154(b) by 0 days.

(21) Appl. No.: 15/033,764

(22) PCT Filed: Nov. 14, 2014

(86) PCT No.: PCT/JP2014/005743
§ 371 (c)(1),
(2) Date: May 2, 2016

(87) PCT Pub. No.: WO2015/072151
PCT Pub. Date: May 21, 2015

(65) Prior Publication Data

US 2016/0271502 A1 Sep. 22, 2016

(30) Foreign Application Priority Data

Nov. 18, 2013 (JP) ..... 2013-237831

(51) Int. Cl.
*F21V 3/00* (2015.01)
*A63G 31/12* (2006.01)
(Continued)

(52) U.S. Cl.
CPC ..... *A63G 31/12* (2013.01); *A47C 7/725* (2013.01); *A63G 5/00* (2013.01); *A63G 9/00* (2013.01);
(Continued)

(58) Field of Classification Search
CPC ..... F21V 3/026
(Continued)

(56) References Cited

U.S. PATENT DOCUMENTS

2008/0185785 A1* 8/2008 Sullivan ..... A63B 43/06 273/317
2008/0266833 A1* 10/2008 Thomas ..... A45B 3/04 362/84
(Continued)

FOREIGN PATENT DOCUMENTS

JP 07192519 A 7/1995
JP 3044262 U 12/1997
(Continued)

OTHER PUBLICATIONS

Nakamura, Yukari; International Preliminary Report on Patentability; International Patent Application No. PCT/JP2014/005743; May 24, 2016; International Bureau of WIPO; Geneva, Switzerland.
(Continued)

*Primary Examiner* — Sean Gramling
(74) *Attorney, Agent, or Firm* — Stevens & Showalter, LLP

(57) ABSTRACT

To provide an ornament mechanism comprising a light-emitting element applied to an elastic material, and, a sports equipment and an amusement equipment decorated by the ornament mechanism.
This ornament mechanism is provided with a transparent air cover and a light-emitting element. The transparent air cover is a cover that covers a core body and has air sealed inside. The light-emitting element is disposed between the core body and the transparent air cover.

12 Claims, 16 Drawing Sheets

(51) Int. Cl.

| | |
|---|---|
| ***A47C 7/72*** | (2006.01) |
| ***A63G 9/00*** | (2006.01) |
| ***A63G 5/00*** | (2006.01) |
| *A63G 11/00* | (2006.01) |
| *F21W 121/00* | (2006.01) |

(52) U.S. Cl.
CPC ..... *A63G 11/00* (2013.01); *F21W 2121/00* (2013.01)

(58) Field of Classification Search
USPC ..... 362/311.13
See application file for complete search history.

(56) References Cited

U.S. PATENT DOCUMENTS

2009/0109661 A1* 4/2009 Holderman ..... A47C 7/725 362/131
2011/0051405 A1* 3/2011 Chien ..... F21S 9/02 362/183
2011/0244971 A1 10/2011 Ochi

FOREIGN PATENT DOCUMENTS

| | | | |
|---|---|---|---|
| JP | 09327356 | | 12/1997 |
| JP | 2007026827 | A | 2/2007 |
| JP | 2009119230 | A | 6/2009 |
| JP | 2014018225 | A | 2/2014 |
| WO | 2006043412 | A1 | 4/2006 |

OTHER PUBLICATIONS

International Search Report and Written Opinion of the International Searching Authority; International Application No. PCT/JP2014/005743; dated Jan. 27, 2015; Japanese Patent Office; Tokyo, Japan.

* cited by examiner

ORNAMENT MECHANISM, AND ORNAMENT, SPORTS EQUIPMENT, AND AMUSEMENT EQUIPMENT USING SAME

TECHNICAL FIELD

The present invention relates to an ornament mechanism, and relates to an ornament using the ornament mechanism. In particular the present invention relates to an ornament mechanism available for ornament with ornament such as an LED, and the present invention relates to ornament, sports equipment, and amusement equipment using the same.

BACKGROUND ART

The whole of playground equipment is often coated by forming a soft material cover such as urethane as a covering of a large-sized playground equipment placed in an indoor amusement park. Alternatively, playground equipment is often formed of soft material. Furthermore, there are many playground equipments provided with a light emitter. For example, playground equipment for a cushion formed with material having different resilience is disclosed in Japanese Unexamined Pat. Application Publication No. 2004-173,807. Furthermore, the playground equipment provided with the light emitter is disclosed in Japanese Unexamined Pat. Application Publication No. 2006-87896.

SUMMARY OF THE INVENTION

Like a technology of the disclosure in above patent document, in the softening part (for example the holding part for a user), the conventional playground equipment didn't apply the light emitter. Like a technique of two Japanese Unexamined Pat. Noted above, it was only applied to a foot portion or a display panel portion. The light of the light emitter is strong to some extent, so they didn't want to use light emitter at the point where the face of the user touches. On the other hand, because a blinking light is popular with children, the playground equipment maker had much demand to use the blinking light for the playground equipment.

An object of the present invention brought about in view of the circumstance described above, is to make available an ornament mechanism and an ornament, sports equipment and playground equipment using the ornament mechanism, by using the light emitter for the soft part needed so that a user can hold onto.

The present invention involves an ornament mechanism having a frame as a core of a product. The ornament mechanism comprises a translucent air cover and a light emitting device. The translucent air cover is for covering the core and for sealing air inside. A light emitting device is placed between the core and the translucent air cover. The translucent air cover will decrease quantity of light of the light emitting device by placing the light emitting device between the core and the translucent air cover. Therefore, the light emitting device can be used in the place where a face of the user touches. Furthermore, because the surface of the frame can be softened by the translucent air cover, the light emitting device may be applied to a soft material.

It is desirable that the translucent air cover includes a translucent sheet and a plurality of translucent air members having sealed air inside and being placed on the translucent sheet. It is desirable that the translucent air members are translucent cylindrical members having sealed air inside. The translucent air cover which seals air inside can be fabricated from a cylindrical member. The translucent air cover is placed on an elastic member coating the core. The light emitting device is placed between the elastic member and the translucent air cover. Impact when a user collides is further absorbed because repulsion of cushion further rises by the elastic member.

It is further desirable that a translucent sheet coating the translucent air cover is provided. It is desirable that the translucent sheet is a reflection hologram sheet. Because light of the light emitting device can be irregularly reflected by the reflection hologram sheet, the light of the light emitting device can be further softened. The ornament mechanism of the article described above can decorate sports equipment, playground equipment, and/or furniture.

An ornament can be the sports equipment decorated by the ornament mechanism. The ornament comprises an elastic core body, a light emitting device for winding around the elastic core body, a translucent air cover and a translucent sheet. The translucent air cover is for covering the core body and the light emitting device wound around the core body and for sealing air inside. The translucent sheet coats the translucent air cover.

An ornament can be the playground equipment decorated by the ornament mechanism. The ornament comprises an elastic core body, a light emitting device for winding around the elastic core body, a translucent air cover and a translucent sheet. The translucent air cover is for covering the core body and wound around the light emitting device and for sealing air inside. The translucent sheet coats the translucent air cover.

The present invention is an ornament mechanism having a frame as a core of a product. The ornament mechanism comprises a translucent air cover and a light emitting device. The light-emitting device is disposed between the core and the translucent air cover. The translucent air cover will decrease the quantity of light of the light emitting device by placing the light emitting device between the core and the translucent air cover. Therefore, the light emitting device can be used in the place where the face of the user touches. Furthermore, because the surface of the frame can be soft by the translucent air cover, the light emitting device may be applied to a soft material.

DESCRIPTION OF THE PREFERRED EMBODIMENT

Preferred Embodiment 1

Figure 2:
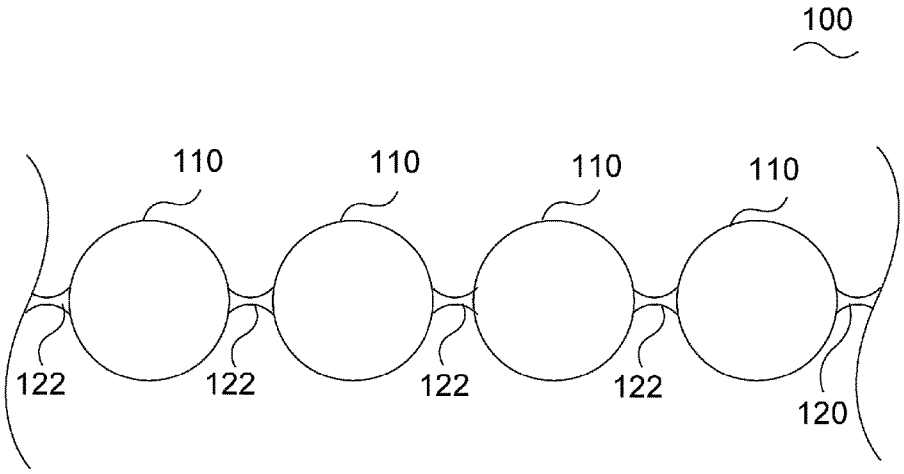
FIG. 2 is a front view indicating an outlined configuration of a transparent air cover in accordance with an embodiment of the present invention.
Figure 3:
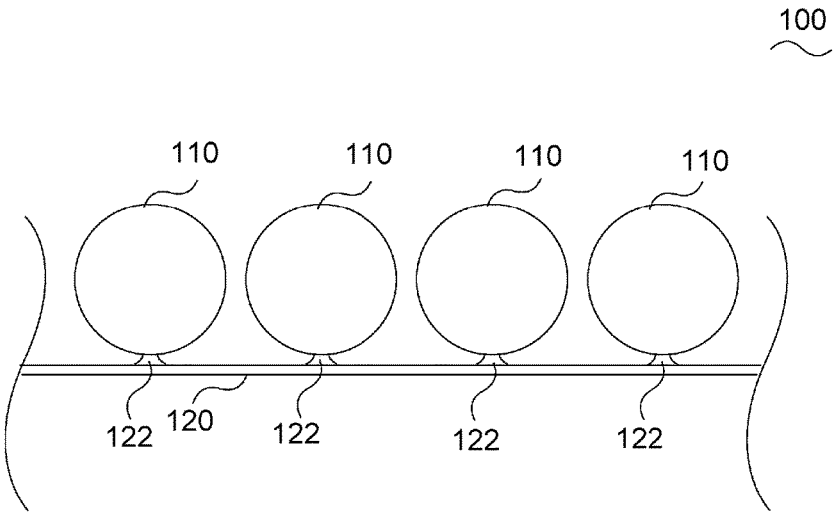
FIG. 3 is a front view indicating an outlined configuration of a transparent air cover in accordance with an embodiment of the present invention.
Figure 4:
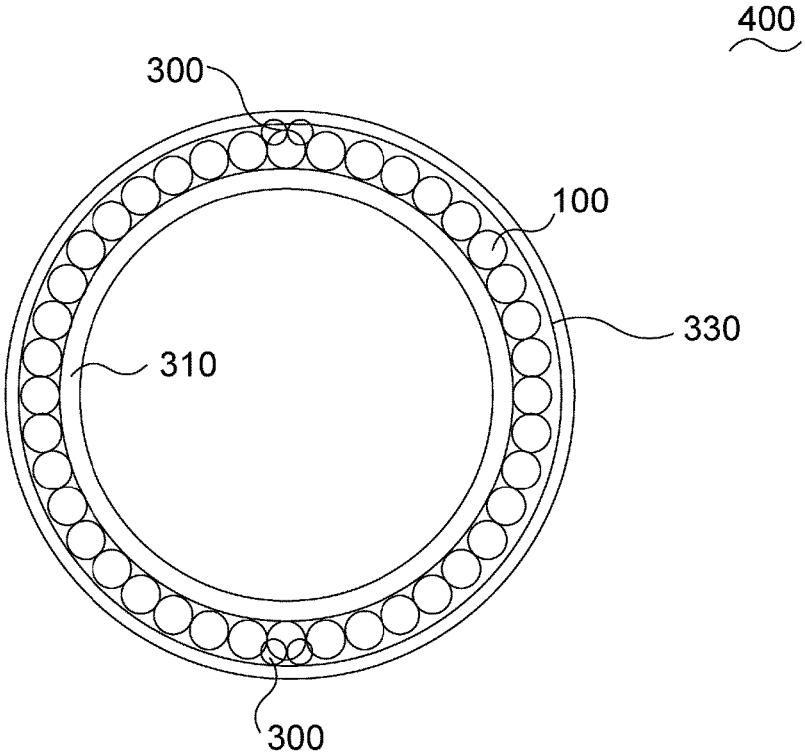
FIG. 4 is a cross section view illustrating an outlined configuration of an ornament mechanism in accordance with an embodiment of the present invention.
Figure 5:
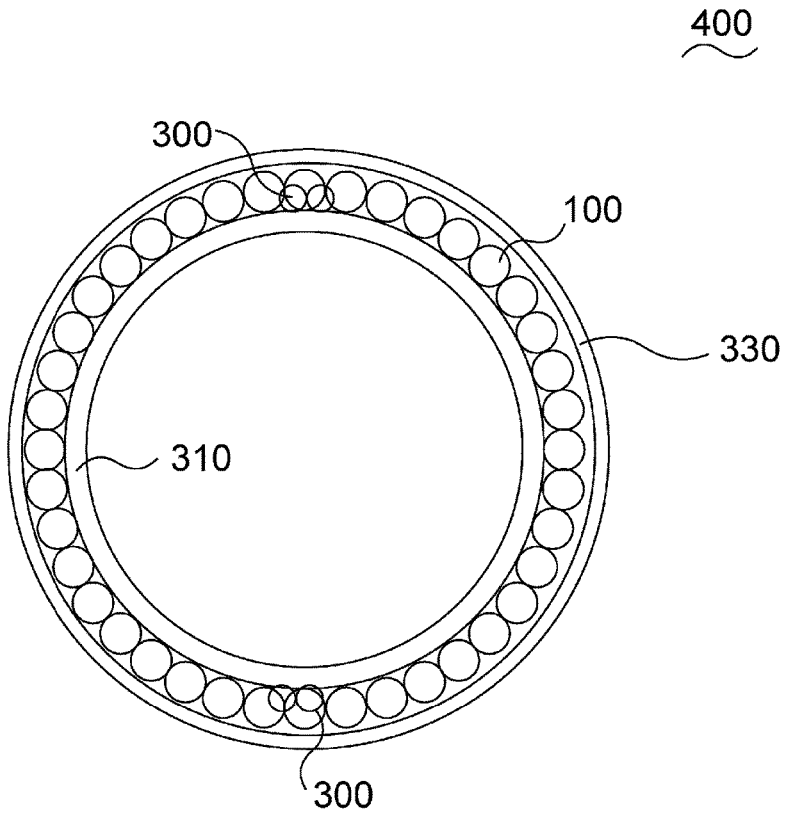
FIG. 5 is a cross section view illustrating an outlined configuration of an ornament mechanism in accordance with an embodiment of the present invention.

Sports equipment 100 is described below as an example of an ornament using an ornament mechanism of this invention with reference to the drawings. FIG. 1, FIG. 3, FIG. 4, and FIG. 5 are sectional drawings indicating the outlined configuration of ornament mechanism 400 of this invention. FIG. 2 and FIG. 3 are front elevation views indicating the outlined configuration of transparent air covering 100 of this invention. However, the details of all parts which do not directly-relate to the present invention will be omitted.

Figure 1:
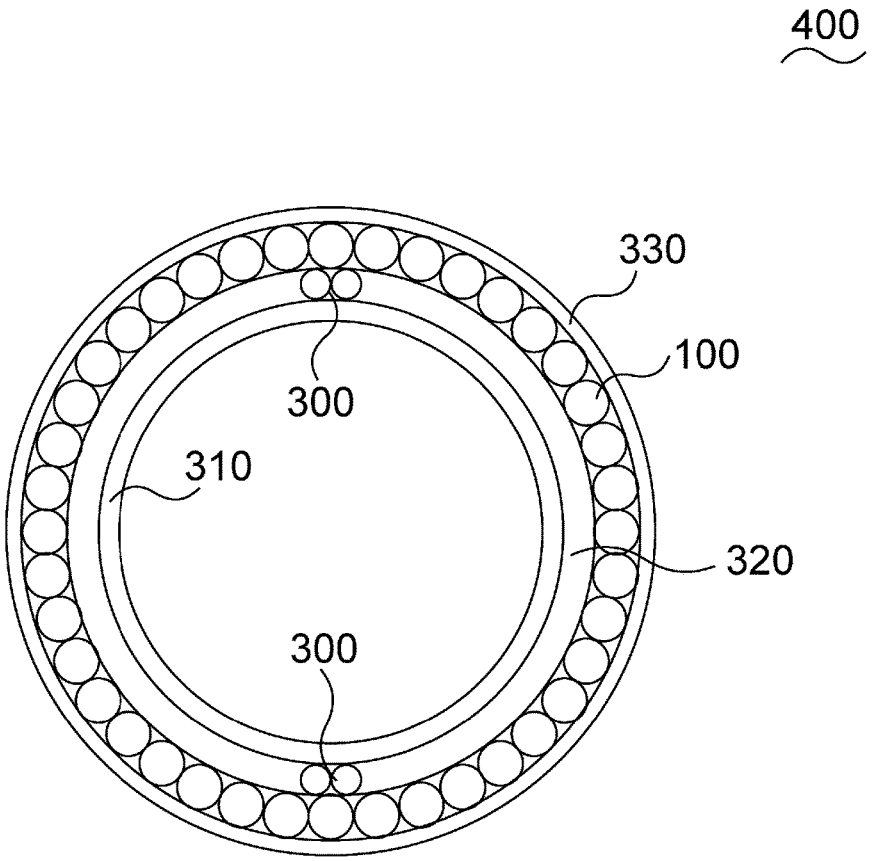
FIG. 1 is a cross section view illustrating an outlined configuration of an ornament mechanism in accordance with an embodiment of the present invention.

That is, as shown in FIG. 1, the ornament mechanism 400 of this invention includes an elastic member filled with air and also includes a light emitter (LED 300 later described). The ornament is formed using the ornament mechanism 400 for predetermined frame 310 (it is described below). At first a transparent air covering 100 which is filled with air is formed. For example, as shown in FIG. 2 and FIG. 3, a plurality of cylindrical members 110 with both ends closed is formed by using an elastic material of the transmittance. Each of the plurality of cylindrical members 110 is formed by rolling up an elastic member and closing the both ends. The transparent air covering 100 is formed by placing the plurality of cylindrical members 110 at a predetermined distance with lateral faces of the cylindrical members 110 facing each other. A joint 122 connects each of the cylindrical members 110. Alternatively, as shown in FIG. 3, the plurality of cylindrical members 110 may be placed on transparence sheet 120, and the joint 122 may couple each of the plurality of cylindrical members 110 with the transparent sheet 120. In use, one may cut between the cylindrical members 110.

For easily disconnecting between each of the plurality of cylindrical members 110 an auxiliary member may be placed between the cylindrical members 110. For example, two stick shape auxiliary members are placed between the cylindrical members 110. The auxiliary members as a guide allow one to cut straight between the auxiliary members. After cutting between the auxiliary members, the auxiliary members can be coupled with a joint member. For example, the joint member is formed by connecting two fitting parts which can engage an auxiliary member. The auxiliary members can couple by fitting the auxiliary member to the fitting parts. Air is sealed within the cylindrical member 110 by sealing both ends of the cylindrical member 110. Thus, by rebounding, even if the user came across transparent air cover 100 including cylindrical member 110, injury of the user can be prevented. The transparent air cover 100 can use any type of elastic member if a part of light of the later LED 300 can be blocked and a frame can be coated.

An ornament is formed by using the transparence air cover 100 formed as above. The ornament of this invention can be made if the product has the frame. For example, it can be used for furniture such as a chair or bed, for playground equipment, and for an ornament in a building. As an example of the ornament using the transparent air cover 100 as follows, sports equipment installed in an indoor amusement park is described. With reference to FIG. 1, FIG. 3, FIG. 4, and FIG. 5, sports equipment frame 310 having a shape of circular cross-section will be explained (the shape of the frame may be oval). At first an elastic member such as urethane 320 is coated to the frame 310 as the core. In the present embodiment, the frame 310 is coated with the urethane 320 formed into a pipe form.

After having coated the sports equipment frame 310 with the urethane 320 as described above, a lighting member such as LED 300 is placed on the urethane 320. In keeping LED 300 between the urethane 320 and the transparent air cover 100, the transparent air cover 100 is placed on the urethane 320. Because the transparent air cover 100 including the air space blocks a part of light of the LED 300, the light does not enter the eye of the user directly. Therefore, the user will see an indistinct light. The transparent air cover 100 can use any type of elastic member if a part of light of the LED 300 can be blocked and the frame 310 can be coated. The urethane 320 is placed to the sports equipment frame 310, and the ornament mechanism 400 of this invention is configured by placing the transparent air cover 100 on the urethane 320 in keeping the LED 300 between the urethane 320 and the transparent air cover 100.

In the present embodiment, it will be further coated with a transparent cover 330 after having coated the transparent air cover 100 as described above. For example, a transparence sheet is cut into the shape that can coat the sports equipment frame 310 coated with the transparent air cover 100. The transparent cover 330 is formed by welding or by sewing a transparence sheet and a fastening-means such as fasteners. The transparent cover 330 is formed of a so-called 3D sheet or a hologram sheet. For example it is formed by laminating a stereoscopic image made by special photography. Or it is formed by laminating the sheet with printed images capable to change when a product is moved or an observer moves their eyes, and by laminating the lenticular lens which arranged lot of cylindrical lenses.

The transparent air cover 100 may be used outside of the cylindrical member 110, or may be used inside of the cylindrical member 110. Particularly, the transparent air cover 100 forms an irregularity by being used outside of the cylindrical member 110. Thereby, the irregularity is formed to the ornament mechanism 400, so the ornament mechanism 400 which a user can easy hold is configured. The sports equipment frame 310 can be directly coated with the transparent air cover 100, and the transparent air cover 100 may be coated with the transparent cover 330. In this case, the LED 300 will be placed between the frame 310 and the transparent air cover 100 or between the transparent air cover 100 and the transparent cover 330.

Also, a light emitting device of the ornament mechanism 400 of this invention may flash on and off in accordance with music. A flash pattern is registered beforehand, and the flash pattern which the user hopes for may be performed.

Preferred Embodiment 2

Figure 6:
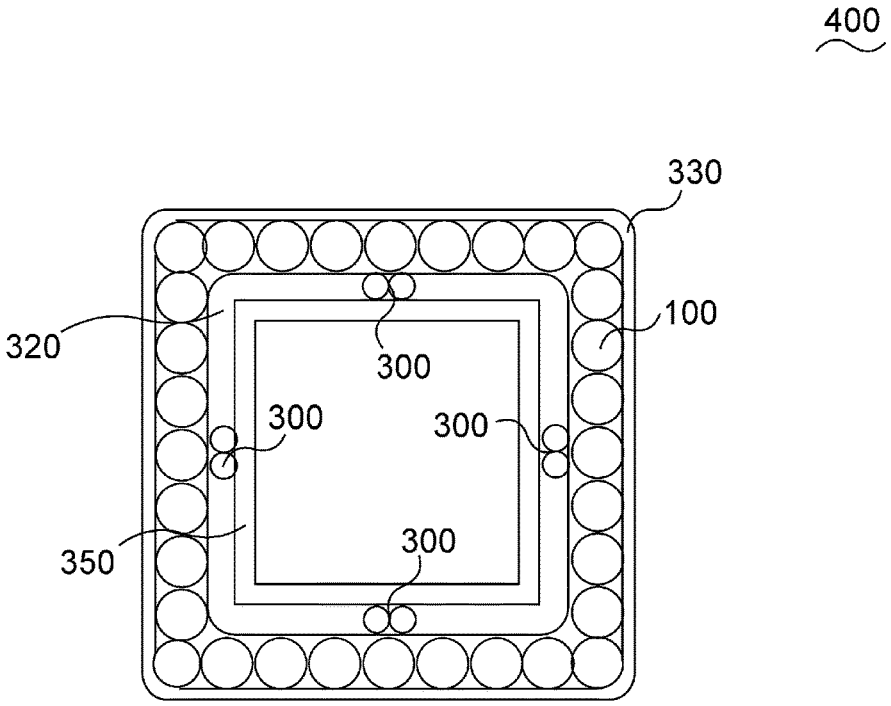
FIG. 6 is a cross section view illustrating an outlined configuration of an ornament mechanism in accordance with an embodiment of the present invention.
Figure 7:
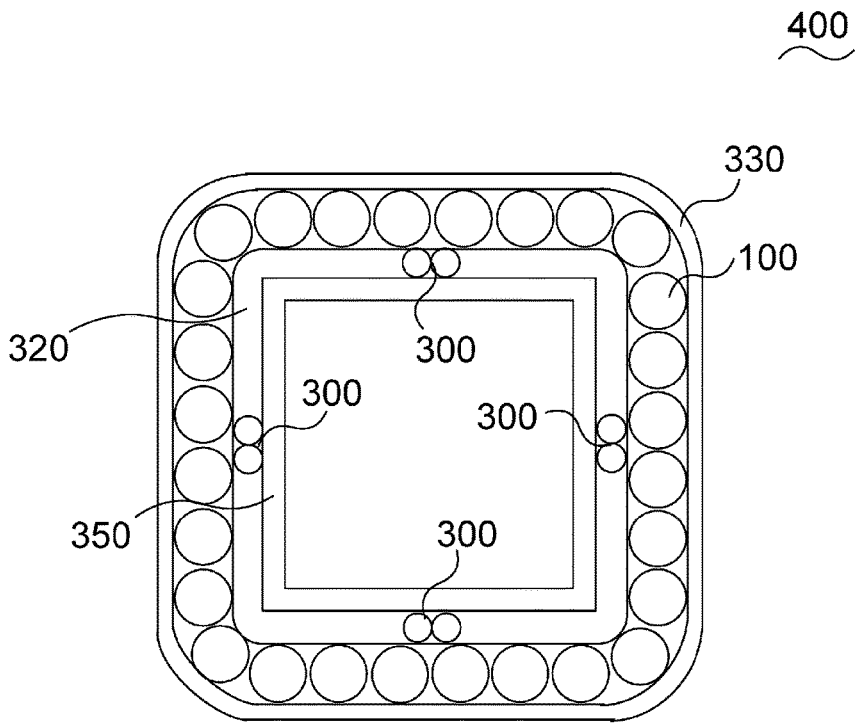
FIG. 7 is a cross section view illustrating an outlined configuration of an ornament mechanism in accordance with an embodiment of the present invention.

Then, with reference to FIG. 6 and FIG. 7, a rectangular frame 350 is described (the shape of the frame 350 may be rectangular having rounded). Because configuration other than the shape of a rectangle frame is the same as the detailed description of the preferred embodiment 1, the illustration description is omitted. At first an elastic member such as urethane 320 is coated to the frame 350. For example, the frame 350 is coated with the urethane 320 with a rectangle shape. A rectangle form may be formed by making a cut slit in the sheet of the urethane 320.

After having coated the sports equipment frame 350 with the urethane 320 as described above, a lighting member such as LED 300 is placed on the urethane 320. In keeping the LED 300 between the urethane 320 and transparent air cover 100, the transparent air cover 100 is placed on the urethane 320. The transparent air cover 100 sealing up the air space blocks a part of the light of the LED 300, and the light does not enter the eye of a user directly. Therefore, the user will see an indistinct light. The transparent air cover 100 can use any type of elastic member if a part of the light of the LED 300 can be blocked and the frame 350 can be coated. The urethane 320 is placed to the sports equipment frame 350, and ornament mechanism 400 of this invention is configured by placing the transparent air cover 100 on the urethane 320 in keeping the LED 300 between the urethane 320 and the transparent air cover 100.

In the present embodiment, it will be further coated with transparent cover 330 after having coated the transparent air cover 100 as described above. For example, a transparence sheet is cut into the shape that can coat the sports equipment frame coated 350 with the transparent air cover 100. The transparent cover 330 is formed by welding or by sewing a transparence sheet and a fastening-means such as fasteners. The transparent cover 330 is formed of a so-called 3D sheet or a hologram sheet. For example it was formed by laminating a stereoscopic image made by special photography. Or it is formed by laminating the sheet with printed images capable to change when a product is moved or you move your eyes, and by laminating the lenticular lens which arranged lot of cylindrical lenses.

The transparent air cover 100 may be used outside of the cylindrical member 110 (cf. FIG. 7), or may be used inside of the cylindrical member 110 (cf. FIG. 6). Particularly, the transparent air cover 100 forms an irregularity by being used outside of the cylindrical member 110. Thereby, the irregularity is formed to the ornament mechanism 400, so the ornament mechanism 400 which the user can easy hold is configured.

The sports equipment frame 350 can be coated with the transparent air cover 100 directly, and the transparent air cover 100 may be coated with the transparent cover 330. In this case, the LED 300 will be placed between the frame 350 and the transparent air cover 100 or between transparent air cover 100 and the transparent cover 330.

Also, the light emitting device 300 of the ornament mechanism 400 of this invention may flash on and off in accordance with music. A flash pattern is registered beforehand, and the flash pattern which the user hopes for may be performed.

Preferred Embodiment 3

Figure 8:
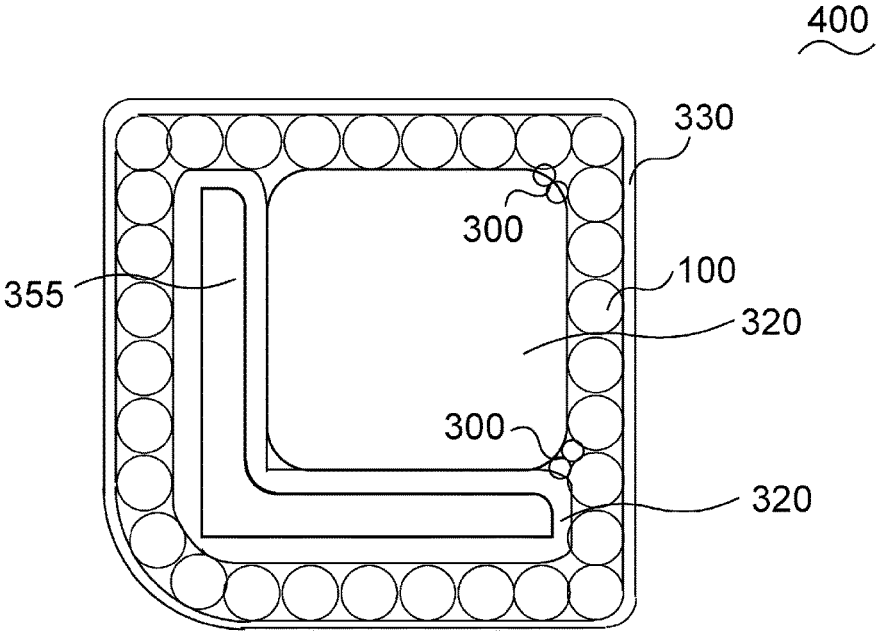
FIG. 8 is a cross section view illustrating an outlined configuration of an ornament mechanism in accordance with an embodiment of the present invention.
Figure 9:
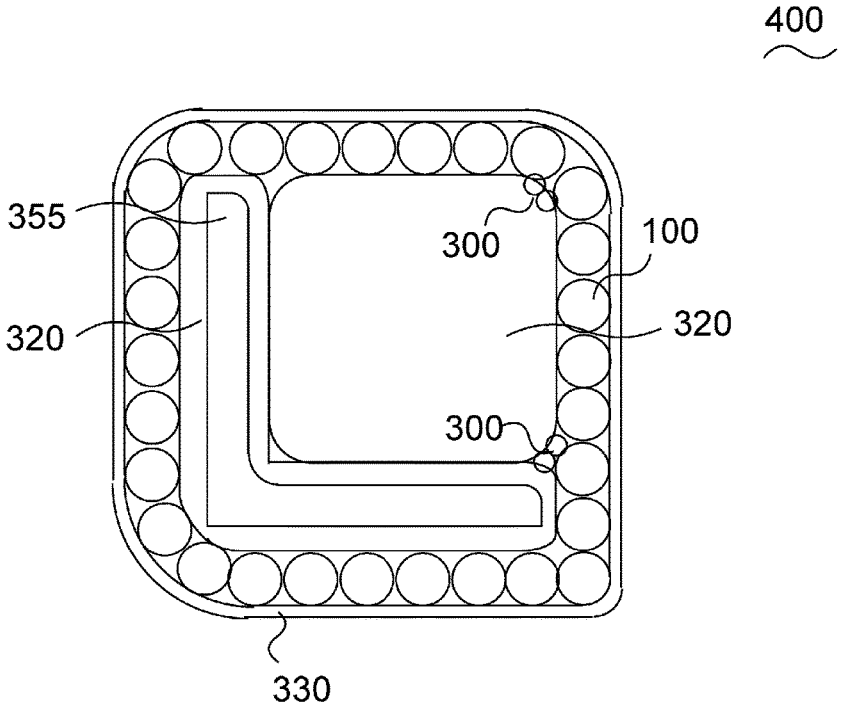
FIG. 9 is a cross section view illustrating an outlined configuration of an ornament mechanism in accordance with an embodiment of the present invention.

Then, with reference to FIG. 8 and FIG. 9, an angle steel frame 355 is described (the shape of frame 355 may be equal angle steel or non-equal angle steel). Because the configuration of this embodiment, other than the shape of the angle steel frame 355, is the same as the detailed description of the preferred embodiment 1, the illustration description is omitted. At first an elastic member such as urethane 320 is coated to the angle steel frame 355. For example, a rectangle form is formed by placing the urethane 320 of the horniness between two sides of the angle steel frame 355, the frame is coated with the urethane 320 with a rectangle shape. A rectangle form may be formed by making a cut slit in the sheet of the urethane 320.

After having coated the angle steel sports equipment frame 355 with the urethane 320 as described above, a lighting member such as LED 300 is placed on the urethane 320. In keeping LED 300 between the urethane 320 and transparent air cover 100, and the transparent air cover 100 is placed on the urethane 320. Because the transparent air cover 100 sealing up the air space blocks a part of light of the LED 300, the light does not enter the eye of the user directly. Therefore, the user will see an indistinct light. The transparent air cover 100 can use any type of elastic member if a part of the light of the LED 300 can be blocked and the angle steel frame 355 can be coated. The urethane 320 is placed to the angle steel sports equipment frame 355, and ornament mechanism 400 of this invention is configured by placing the transparent air cover 100 on the urethane 320 in keeping the LED 300 between the urethane 320 and transparent air cover 100.

In the present embodiment, it will be further coated with transparent cover 330 after having coated the transparent air cover 100 as described above. For example, a transparence sheet is cut into the shape that can coat the sports equipment frame 355 coated with the transparent air cover 100. The transparent cover 330 is formed by welding or by sewing a transparence sheet and a fastening-means such as fasteners. The transparent cover 330 is formed of a so-called 3D sheet or a hologram sheet. For example it is formed by laminating a stereoscopic image made by special photography. Or it is formed by laminating the sheet with printed images capable to change when a product is moved or you move your eyes, and by laminating the lenticular lens which arranged lot of cylindrical lenses.

The transparent air cover 100 may be used outside of cylindrical member 110 (cf. FIG. 9), or may be used inside of the cylindrical member 110 (cf. FIG. 8). Particularly, the transparent air cover 100 forms an irregularity by being used outside of the cylindrical member 110. Thereby, the irregularity is formed to ornament mechanism 400, so the ornament mechanism 400 which a user can easy hold is configured.

The sports equipment frame 355 can be coated with the transparent air cover 100 directly, and the transparent air cover 100 may be coated with the transparent cover 330. In this case, the LED 300 will be placed between the angle steel frame 355 and the transparent air cover 100 or between the transparent air cover 100 and the transparent cover 330.

Figure 14:
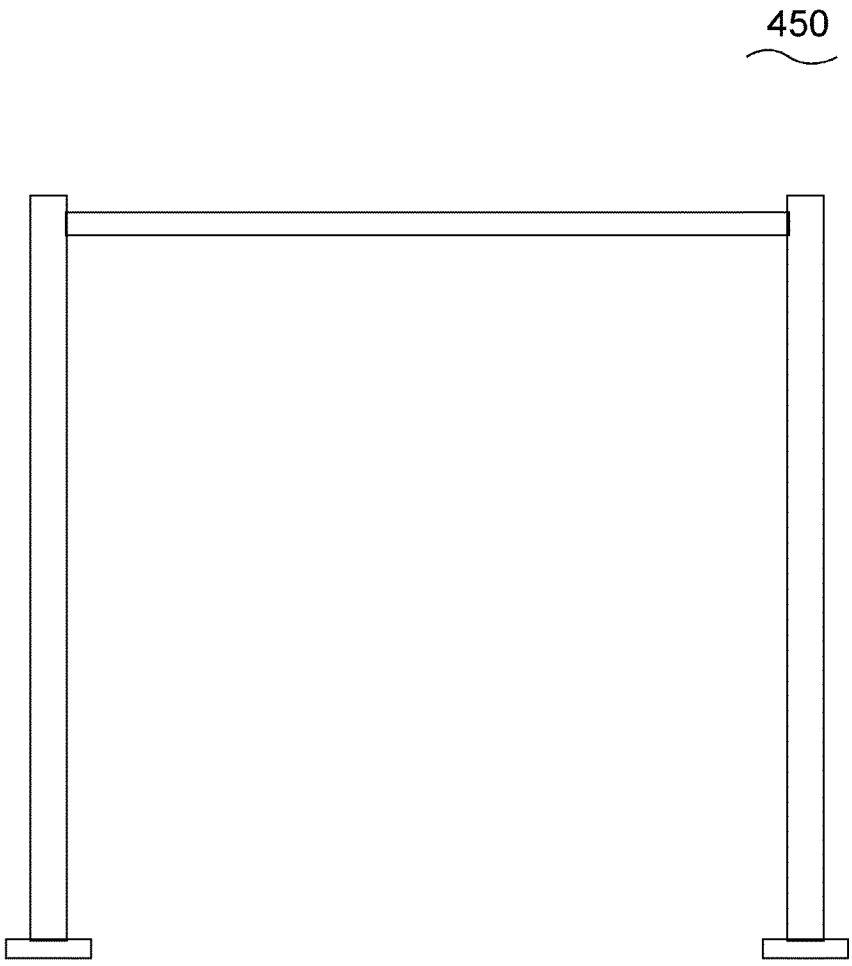
FIG. 14 is a front view indicating an outlined configuration of playground equipment decorated in the ornament mechanism concerning the embodiment of this Invention.
Figure 15:
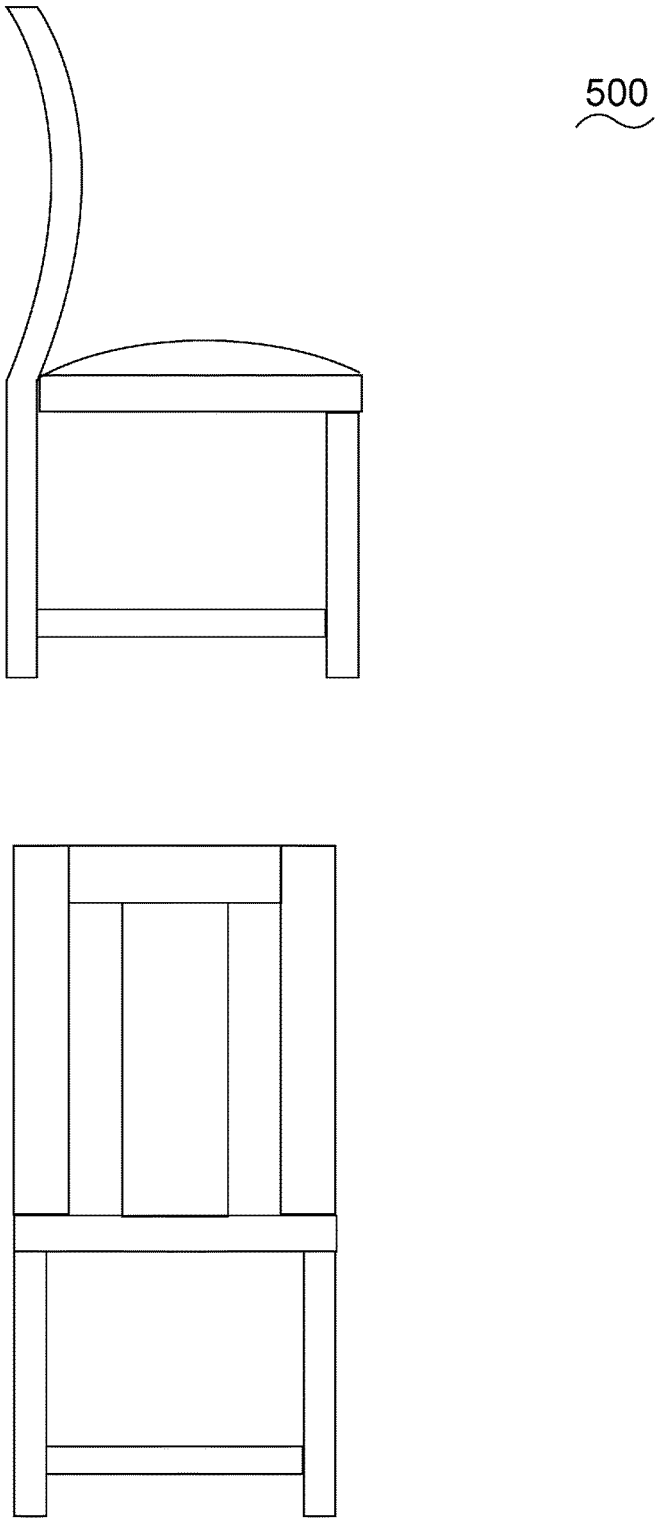
FIG. 15 is a front view indicating an outlined configuration of a chair decorated in the ornament mechanism concerning the embodiment of this Invention.
Figure 16:
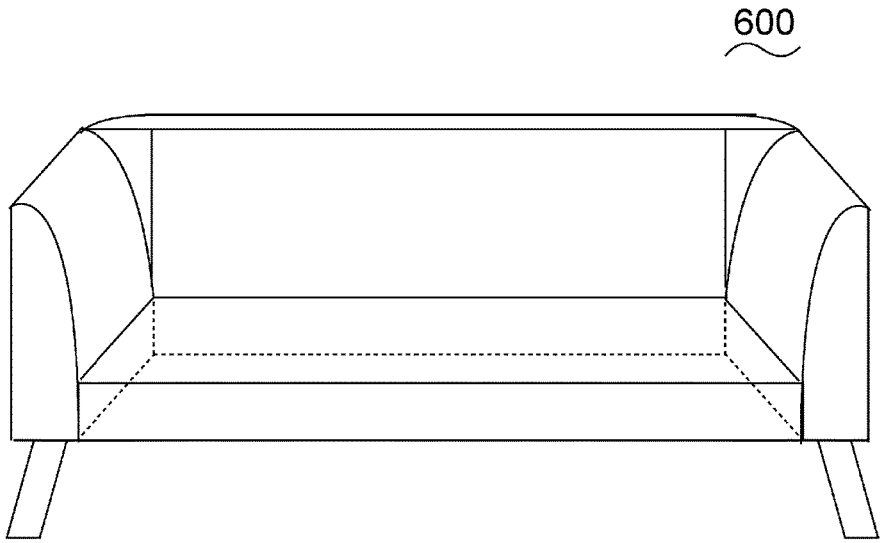
FIG. 16 is a front view indicating an outlined configuration of a sofa decorated in the ornament mechanism concerning the embodiment of this Invention.
Figure 17:
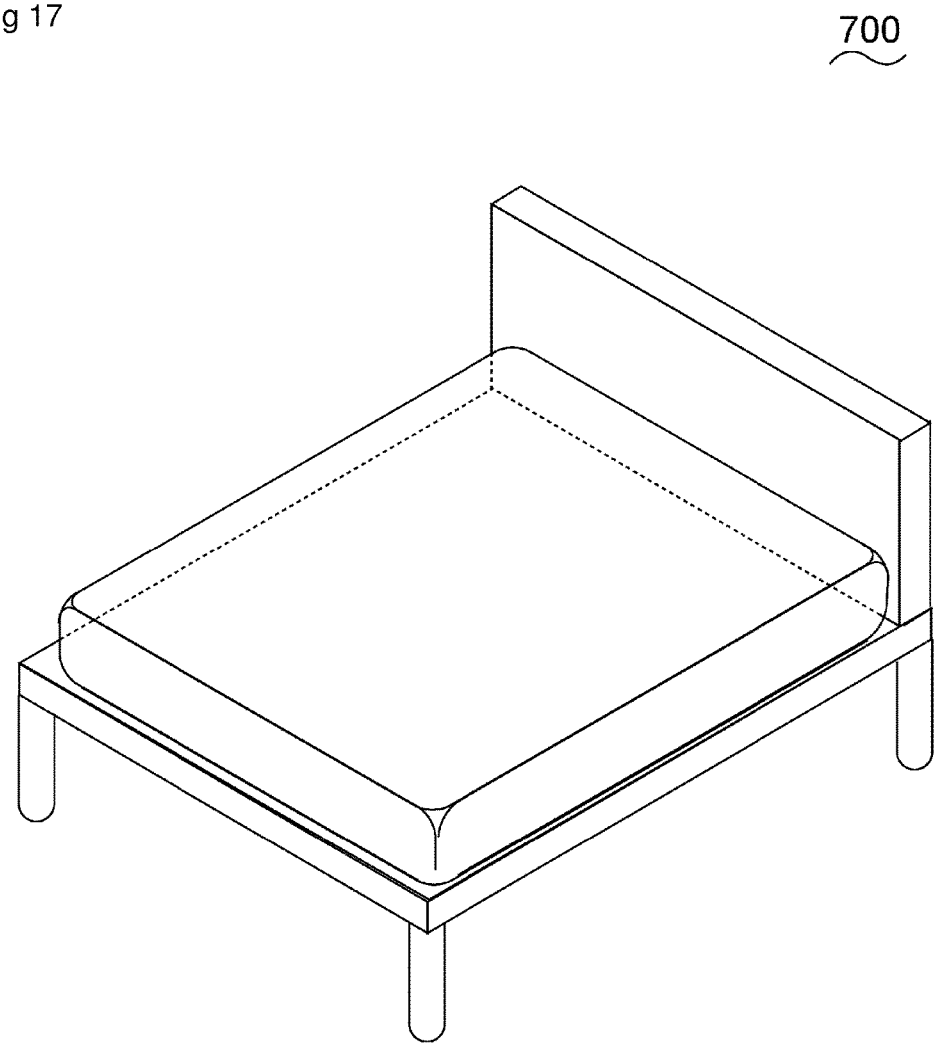
FIG. 17 is a perspective view indicating an outlined configuration of a bed decorated in the ornament mechanism concerning the embodiment of this Invention.

As shown in FIG. 14, sports equipment and playground equipment 450 to decorate with an ornament mechanism 400 of this invention is general equipment placed in a park and an amusement park. For example, sports equipment such as an uphill stick and rotary playground equipment and iron rod, slide, swing, jungle gym, overhead ladder, seesaw, and the jungle gym can be decorated, and a combination of the sports equipment can be decorated in the ornament mechanism 400 of this invention.

Preferred Embodiment 4

Figure 10:
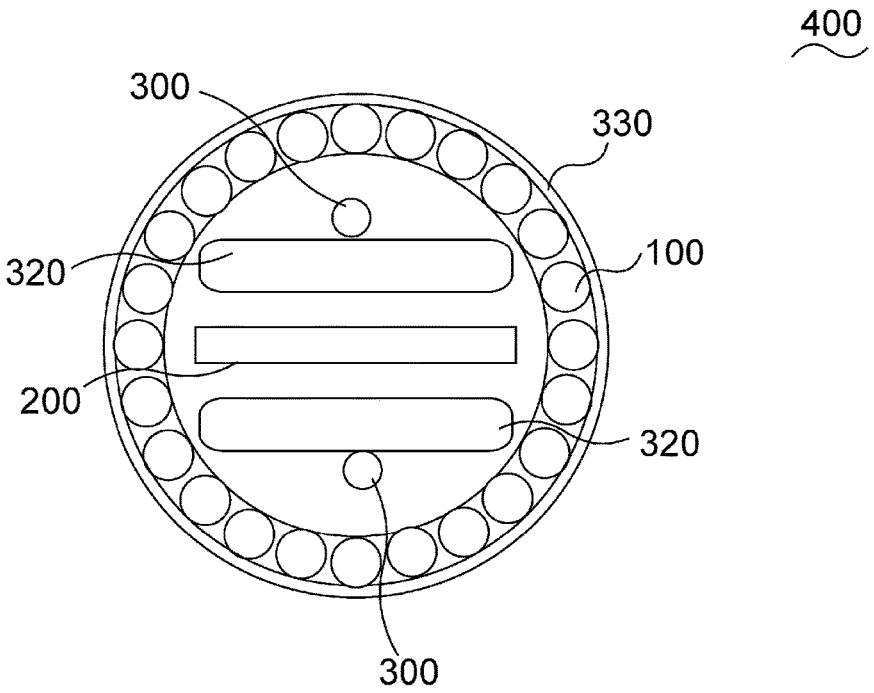
FIG. 10 is a cross section view illustrating an outlined configuration of an ornament mechanism in accordance with an embodiment of the present invention.
Figure 11:
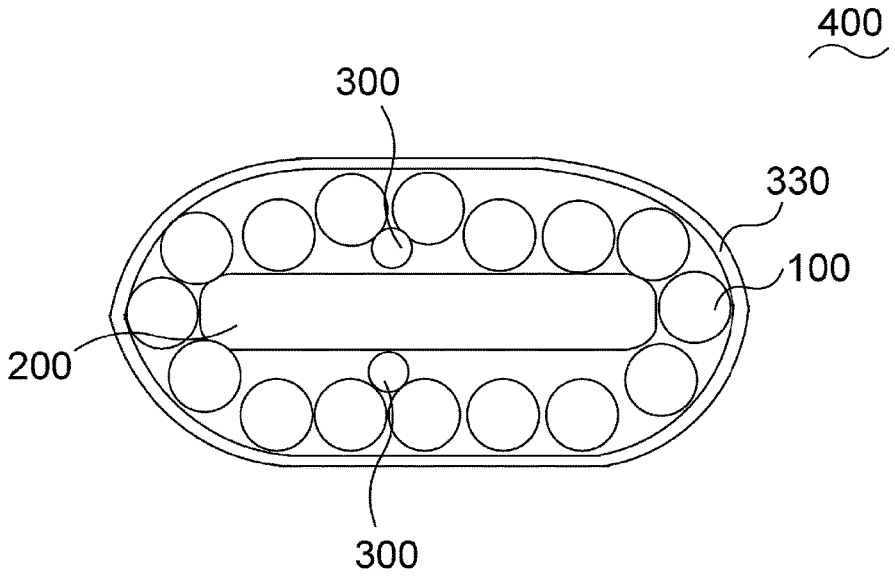
FIG. 11 is a cross section view illustrating an outlined configuration of an ornament mechanism in accordance with an embodiment of the present invention.

With reference to FIG. 10 and FIG. 11, an ornament mechanism 400 of this invention having a member like the band as a core is described. Because configuration other than band parts as a core, is the same as the detailed description of the preferred embodiment 1, the illustration description is omitted.

In the case of the swing a chair part needs to be hung by a band part. Other ornament mechanism 400 of this invention can be applied to the band part of this case. At first band part 200 is sandwiched with an elastic member such as urethane 320. The urethane 320 and the band part 200 are coated with a transparent air cover 100. Furthermore, the ornament mechanism 400 of this invention can be configured by coating with a transparent cover 330. LED 300 is placed between the urethane 320 and the transparent air cover 100. Like FIG. 11, the band part 200 may be coated directly with the transparent air cover 100.

Figure 12:
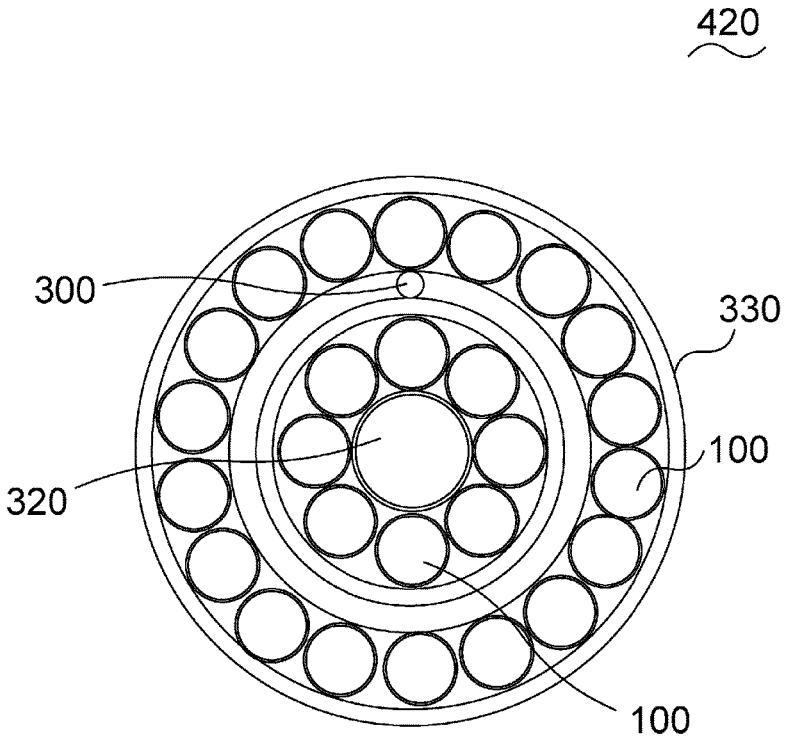
FIG. 12 is a cross section view illustrating an outlined configuration of an ornament in accordance with an embodiment of the present invention.
Figure 13:
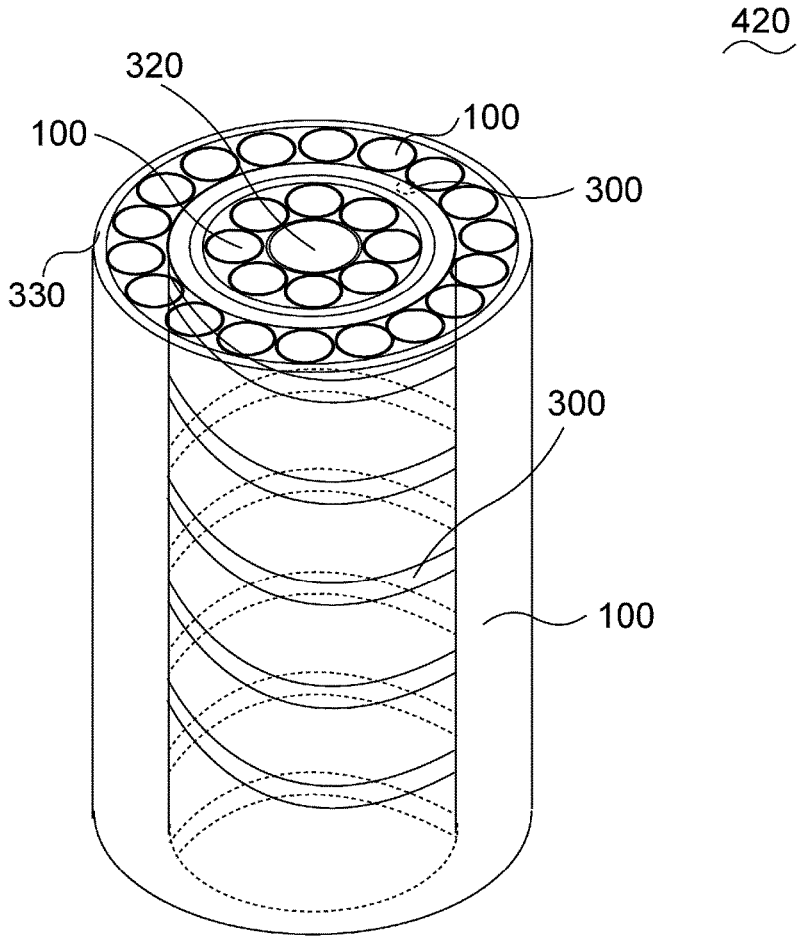
FIG. 13 is a perspective view illustrating an outlined configuration of an ornament in accordance with an embodiment of the present invention.

Furthermore, as shown in FIG. 12 and FIG. 13, an ornament 420 having an elastic member such as urethane 320 as a core can be attached to playground equipment and sports equipment. The urethane 320 is coated with transparent air cover 100 several times. In the present embodiment, the transparent air cover 100 is wound around on the urethane 320 double. The LED 300 is placed between the urethane 320 and the transparent air cover 100. In the present embodiment, the LED 300 is wound around on the urethane 320 as core more than once, and the transparent air cover 100 is wound around on the urethane 320. The transparent air cover 100 is coated with transparent cover 330.

Figure 18:
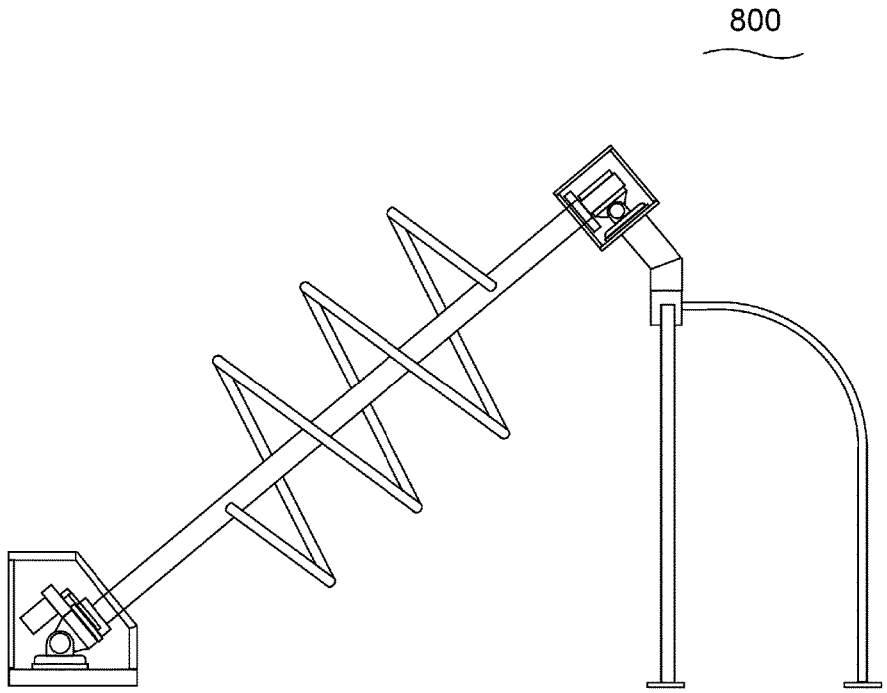
FIG. 18 is a front view indicating an outlined configuration of playground equipment decorated in the ornament mechanism concerning the embodiment of this Invention.
Figure 19:
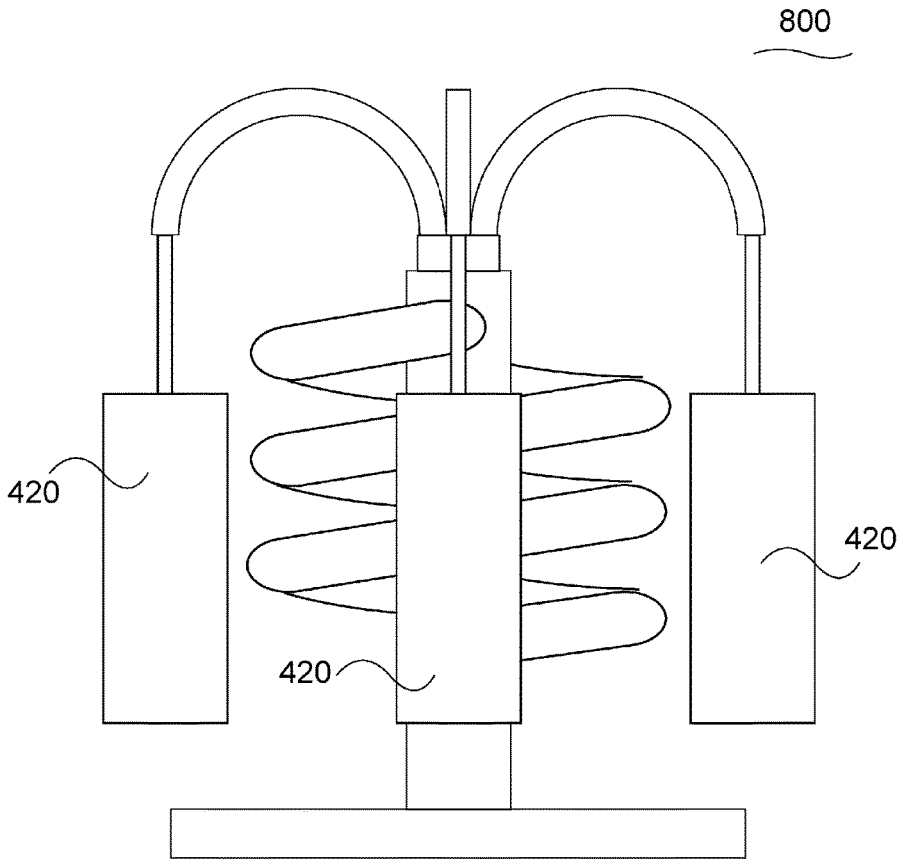
FIG. 19 is a front view indicating an outlined configuration of playground equipment decorated in the ornament mechanism concerning the embodiment of this Invention.
Figure 20:
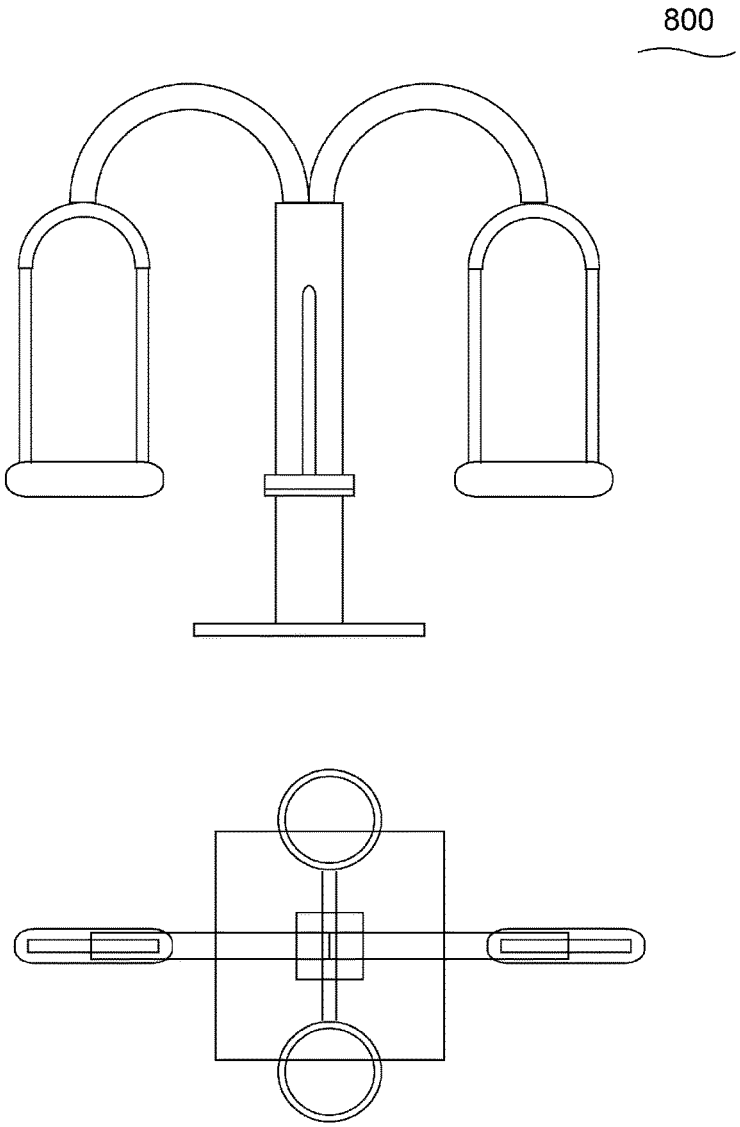
FIG. 20 is a front view and a top view indicating the outlined configuration of play equipment decorated in the ornament mechanism concerning the embodiment of this Invention.

The furniture to decorate with ornament mechanism 400 of this invention may be the general furniture to use at an office and home. For example, as shown in FIG. 14, FIG. 15, FIG. 16, and FIG. 17, furniture such as a chair 500, sofa 600, bed 700 and desk can be applied and a cabinet such as a chest shelf can be applied with the ornament mechanism 400 of this invention. Play equipment 800 to decorate with the ornament mechanism 400 of this invention can configure equipment 800 with rotatably and diagonally placed circular tube bent in a spiral as shown in FIG. 18. Play equipment 800 for hanging down an ornament 420 can be configured as shown in FIG. 19. Seesaw-shaped play equipment 800 can be configured as shown in FIG. 20.

Also, a light emitting device of ornament mechanism 400 of this invention may flash on and off in accordance with music. A flash pattern is registered beforehand, and the flash pattern which the user hopes for may be performed.

INDUSTRIAL APPLICABILITY

The present invention is an ornament mechanism having a frame as a core of a product. The ornament mechanism comprises a translucent air cover and a light emitting device. The light-emitting device is disposed between the core and the translucent air cover. The translucent air cover will decrease quantity of light of the light emitting device by placing the light emitting device between the core and the translucent air cover. Therefore, the light emitting device can be used in the place where the face of the user touches. Furthermore, because the surface of the frame can be softened by the translucent air cover, a light emitting device may be applied to a soft material, which is highly industrially applicable.

What is claimed is:

1. A sports equipment having a frame as a core decorated by an ornament mechanism comprising:

a translucent air cover having sealed air inside, for covering the core; and a light emitting device placed between the core and the translucent air cover;

wherein the light emitting device comprises a line of LEDs wound about the core in a spiral configuration.

2. The sports equipment according to claim 1, wherein said translucent air cover comprises a plurality of cylindrical members filled with air, at least a portion of the cylindrical members being located along a path of light emitted from the light emitting device extending in a direction away from the core such that the light passing through the portion of the cylindrical members is seen by a user as indistinct light.

3. An amusement equipment having a frame as a core decorated by an ornament mechanism comprising:

a translucent air cover having sealed air inside, for covering the core; and a light emitting device placed between the core and the translucent air cover;

wherein the translucent air cover comprises two wrapped sections spaced apart from one another and both positioned about the core.

4. The amusement equipment according to claim 3, wherein said translucent air cover further comprises a translucent sheet and a plurality of translucent air members in which air is sealed inside and the plurality of translucent air members being placed on the translucent sheet.

5. The amusement equipment according to claim 4, wherein each of said plurality of translucent air members is a translucent cylindrical member having sealed air inside.

6. The amusement equipment according to claim 3, further comprising: a translucent sheet for coating the translucent air cover.

7. The amusement equipment according to claim 6, wherein said translucent sheet is a reflection hologram sheet.

8. The amusement equipment according to claim 3, wherein said translucent air cover is placed on an elastic member coating the core, and said light emitting device is placed between the elastic member and the translucent air cover.

9. A sports equipment comprising:

an elastic core body;

a light emitting device for winding around the elastic core body;

a translucent air cover having sealed air inside, for covering the elastic core body, and wound around the light emitting device; and a translucent sheet for coating the translucent air cover;

wherein the light emitting device comprises a line of LEDs wound about the elastic core body in a spiral configuration.

10. An amusement equipment comprising:

an elastic core body;

a light emitting device for winding around the elastic core body;

a translucent air cover having sealed air inside, for covering the elastic core body, and wound around the light emitting device; and a translucent sheet for coating the translucent air cover;

wherein the translucent air cover comprises two wrapped sections spaced apart from one another and both positioned about the elastic core body.

11. An amusement equipment comprising:

an elastic core body;

a light emitting device for winding around the elastic core body;

a translucent air cover having sealed air inside, for covering the elastic core body, and wound around the light emitting device; and a translucent sheet for coating the translucent air cover;

wherein the light emitting device comprises a line of LEDs wound about the elastic core body in a spiral configuration.

12. A sports equipment comprising:

an elastic core body;

a light emitting device for winding around the elastic core body;

a translucent air cover having sealed air inside, for covering the elastic core body, and wound around the light emitting device; and a translucent sheet for coating the translucent air cover;

wherein the translucent air cover comprises two wrapped sections spaced apart from one another and both positioned about the elastic core body.

* * * * *